United States Patent [19]

Kihlstrom

[11] 4,344,232

[45] Aug. 17, 1982

[54] METHOD AND APPARATUS FOR MEASURING ROLL GAP AND ALIGNMENT FOR CONTINUOUS CASTERS

[75] Inventor: Ernest H. Kihlstrom, Valparaiso, Ind.

[73] Assignee: Bethlehem Steel Corporation, Bethlehem, Pa.

[21] Appl. No.: 185,474

[22] Filed: Sep. 9, 1980

[51] Int. Cl.[3] ..... G01B 7/00

[52] U.S. Cl. ..... 33/143 L; 33/147 K; 33/147 N; 33/182

[58] Field of Search ..... 33/143 L, 147 N, 174 L, 33/182, 147 K, DIG. 7

[56] References Cited

U.S. PATENT DOCUMENTS

| | | | |
|---|---|---|---|
| Re. 30,075 | 8/1979 | Gonos et al. | 33/143 L |
| 3,937,271 | 2/1976 | Akiba et al. | 33/182 X |
| 3,983,631 | 10/1976 | Dutzler | 33/143 L |
| 4,132,003 | 1/1979 | Schreive et al. | 33/182 |

FOREIGN PATENT DOCUMENTS

| | | | |
|---|---|---|---|
| 2645022 | 4/1978 | Fed. Rep. of Germany | 33/143 L |

*Primary Examiner*—Harry N. Haroian

*Attorney, Agent, or Firm*—Joseph J. O'Keefe; Michael J. Delaney; George G. Dower

[57] ABSTRACT

Strand-like apparatus for measuring roll position, i.e., roll gap and/or roll alignment, is moved through a caster between roll faces of a series of oppositely spaced pairs of conveyor rolls which define either a straight or curved strand travel path. Apparatus includes carrier means having resiliently deformable parallel sensing surfaces with an elastomeric core, and plural lateral and plural diagonal inductive distance measuring means pivotally linked to the sensing surfaces for generating roll gap and alignment signals. These signals are recorded. Single and multiple harness means attach single and multiple measuring apparatus to a powered starter bar at one or more lateral strand axes, thereby to make lateral roll position measurements during multiple or single passes, respectively.

23 Claims, 6 Drawing Figures

FIG. 3
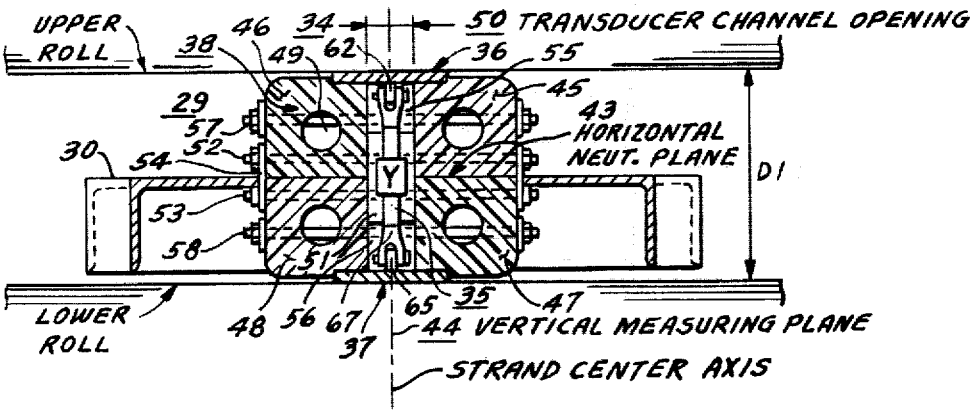
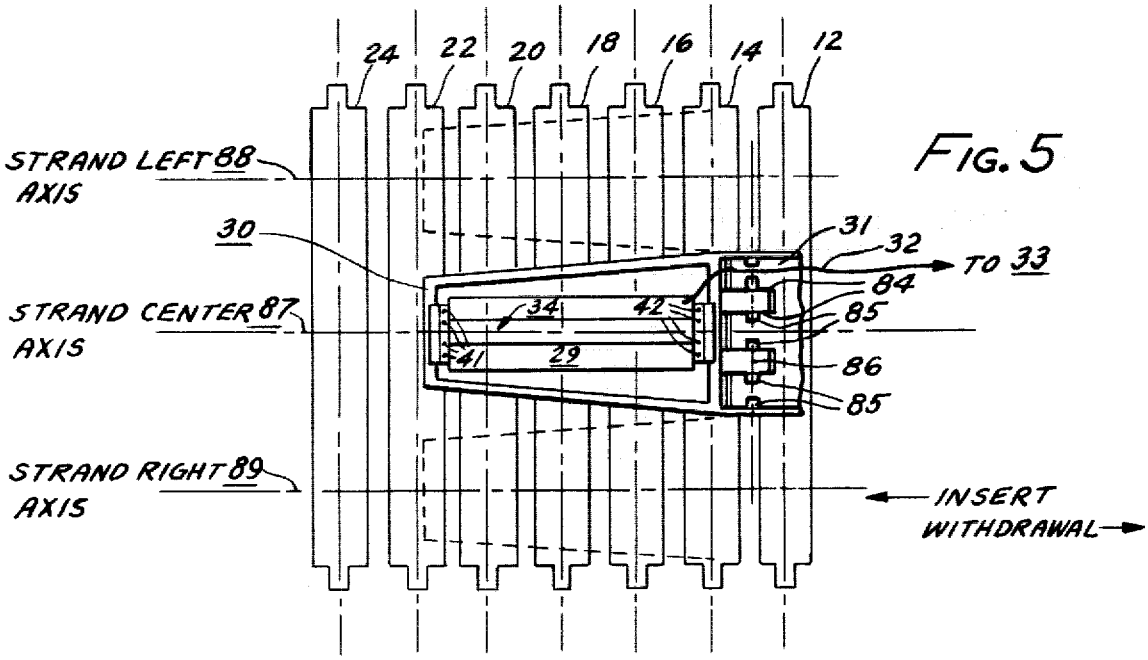
FIG. 5

METHOD AND APPARATUS FOR MEASURING ROLL GAP AND ALIGNMENT FOR CONTINUOUS CASTERS

BACKGROUND OF THE INVENTION

This invention relates to a method and apparatus for measuring the geometric relationship between roll faces of a series of oppositely spaced pairs of conveyor rolls which define straight or curved strand travel path.

DESCRIPTION OF THE PRIOR ART

To effect continuous strand casting, a casting machine (caster) oftimes includes a vertical mold, cooling means for transforming molten metal to solid form, and conveyor roll means of oppositely spaced pairs of rolls which guides a cast strand through curved and straight segments to a horizontal output position. It is extremely important that roll position be properly established and maintained throughout caster operations. Otherwise, improper roll position will degrade product quality, decrease productivity, and increase machine wear as well as increase operator hazards because of breakouts of molten metal. Breakouts also damage caster equipment. The term "roll position" as used herein refers to roll gap and roll alignment at one or more lateral locations along roll faces.

Thus, it has become necessary to compare ideal or nominal caster conveyor roll profile with actual conveyor roll profile after a period of operation, or after repairs to individual rolls and/or segments thereof in cooling, bending or straightening zones of the caster. The comparison procedure requires detailed roll position measurements to be made whenever scheduled or required by roll repair or undue wear. Heretofore, considerable down-time and manpower were required to make conveyor roll profile comparisons, particularly in large casters with high casting capacity. This down-time has an adverse effect on profitability of all caster operations.

Apart from down-time, heretofore there has been no quick, accurate and reliable method or apparatus for making precise caster conveyor roll position measurements, i.e. roll gap and roll alignment, that will aid a caster operator in determining actual conveyor roll profile. Initially, tedious hand measurements were made and recorded. This was not only time consuming but subject to many errors and oversights of roll irregularities. Later, some attempt was made to provide roll position measuring apparatus which was either self-powered to traverse the conveyor roll path, or was powered therethrough with the aid of a starter bar assembly.

In each prior art case, multiple displacement transducers operating from a neutral or reference plane and extending through a housing into contact with a conveyor roll surface is required to make a single roll gap measurement. One prior art device is provided with an additional pendulum-operated angular transducer to determine roll alignment. Others require additional transducers at a neutral axis or reference plane to measure roll gap and/or alignment. Most prior art devices have a rigid housing and complex mechanisms to detect roll displacement. One such device has a flexible body for following roll position but has lateral instability and other shortcomings as to the amount of accurate information provided for its degree of complexity.

SUMMARY OF THE INVENTION

A main object of this invention is to provide an improved method and apparatus for measuring conveyor roll position so as to better determine conveyor roll profile.

Another object of this invention is to provide a method and apparatus for measuring conveyor roll position more quickly and accurately than heretofore.

Still another object of this invention is to provide a method and apparatus for measuring the gap between opposite pairs of conveyor rolls, and the alignment of adjacent rolls in both straight and curved sections of a caster, as well as at both ends and the center strand axes of each roll in the caster.

Yet another object of this invention is to provide a method and apparatus for measuring conveyor roll position that will result in improved product quality, increase operator safety and caster production, while decreasing caster equipment damage caused by conveyor roll irregularities.

The foregoing objects may be obtained by moving a strand-like apparatus for measuring conveyor roll position through a caster between roll faces of oppositely spaced pairs of conveyor rolls generating plural roll gap and plural roll alignment signals during movement of the apparatus through said rolls, and recording each said signal for analysis by the caster operator. The measuring apparatus includes carrier means having resiliently deformable parallel sensing surfaces with an elastomeric core which exerts the surfaces outwardly, said surfaces extending between two or three pairs of the largest roll faces. The measuring apparatus also including plural lateral and plural diagonal inductive distance measuring means pivotally linked to the sensing surfaces for generating respective plural roll gap and plural roll alignment signals, independently of sensing a neutral or reference plane while generating said signals. One lateral transducer senses roll gap while two diagonal transducers measure alignment of two opposing rolls, this arrangement being duplicated in the carrier means behind the first site to verify roll position measurements of the first set. A single harness means powered by a starter bar locates one roll position measuring apparatus at one of three locations, namely, both lateral ends as well as the center strand axis of each roll in the caster. Alternatively, a multiple harness means powered by the starter bar locates three roll position measuring apparatus in parallel to simultaneously traverse both lateral ends and the center strand axis of each roll in the caster. Roll position measurements are made during insertion and withdrawal modes of the starter bar. Thus, this invention rapidly provides more information concerning the status of caster conveyor roll profile than prior art methods or apparatus.

BRIEF DESCRIPTION OF THE DRAWINGS

FIG. 3 is a schematic lateral cross-section of the conveyor roll position measuring apparatus of FIG. 2.

FIG. 5 is a schematic plan view of a single harness having a single conveyor roll position measuring apparatus adapted to a starter bar for alternate insertion or withdrawal at any of three strand axes.

DESCRIPTION OF PREFERRED EMBODIMENTS

Figure 2:
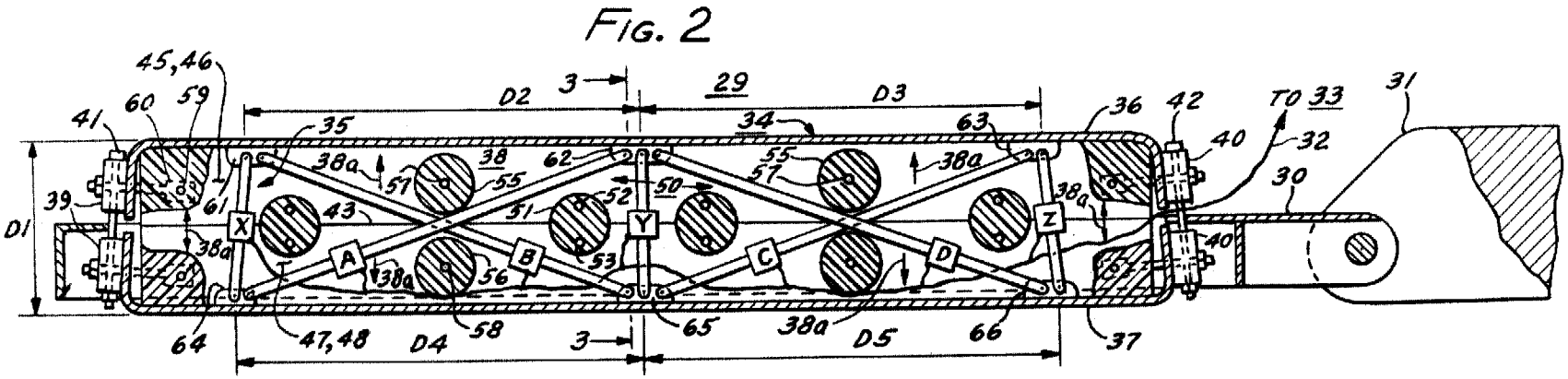
FIG. 2 is a schematic longitudinal cross-section of conveyor roll position measuring apparatus of this invention.

Referring to the drawings, particularly FIGS. 1-4, there is shown in schematic profile cross-section a continuous caster 10 having a partial complement of conveyor rolls used along a strand travel path in a single strand caster. This roll complement comprises a series of straight-section and curved-section of oppositely spaced pairs of conveyor rolls 11,12 to 19,20 and 21,22 to 27,28, respectively. Roll pair 19,20 is referred to as the tangent roll set where a transition from straight to curved section rolls occurs. Conveyor roll position measuring apparatus 29 of this invention is pivotally attached to single harness means 30 which itself is pivotally attached to caster starter bar 31. Starter bar 31 is powered by caster drive rolls (not shown) so that roll position measuring apparatus 29 is moved by way of insertion and withdrawal along the strand travel path from, for example, Position 1 in straight-section roll pairs 13-18 to Position 2 in curved-section roll pairs 23-28, and beyond as will be described below. Conveyor roll measuring apparatus 29 outputs roll position signals over flexible cable 32 to recorder 33. The record from recorder 33 is analyzed by a caster operator as will be explained below.

Main elements of roll position measuring apparatus 29 comprise strand-like carrier means 34 and distance measuring means 35. Strand-like carrier means 34 comprise resiliently deformable upper and lower sensing surfaces 36, 37, and an elastomeric core 38 made of rubber, for example, which exerts an outward-extending expansion force against the sensing surfaces as shown by the arrowheads 38A in FIG. 2. Distance measuring means 35 comprises seven linear distance sensing transducers A, B, C, D, X, Y and Z, such as a commercial inductive type referred to as low voltage differential transformer (L.V.D.T.) type. The function of these distance sensing transducers will be described below.

Parallel sensing surfaces 36,37 are made of metal, preferably stainless steel, and sized so that they will be flat in the straight conveyor roll sections and curvable in the curved roll sections of caster 10, and otherwise sized according to the cross-sectional dimensions of caster 10. For example, if caster 10 were to cast a slab 10" thick by 72" wide, sensor surfaces may be ¼" thick by 6" wide metal spread 10" apart and extended longitudinally between upper and lower roll faces a minimum of two, preferably three, of the largest diameter pairs of rolls in caster 10. Each end of parallel sensor surfaces is canted inward at a predetermined angle when flat, preferably to correspond to radius R curvature of the curved section of caster 10 curved conveyor rolls. Each upper and lower sensor surface 36,37 is provided with a front and rear restraining lug 39,40, respectively, which extends laterally so as to accommodate four each retaining bolts 41,42, respectively. When carrier means 34 is in its free-form outside of the caster, the four front and rear retaining bolts 41,42 slip fit vertically at each end lug 39,40, but restrain outward expansion caused by elastomeric core 38. More importantly, when carrier means 34 is between caster roll forces, retaining bolts 41,42, together with elastomeric core 38, stabilize parallel sensing surfaces 36,37, against lateral movement. Lateral stabilization of these surfaces avoids sideways errors from being introduced into roll position transducers A, B, C, D, X, Y, Z, such as occurs in some prior art devices.

Elastomeric core 38 is constructed of four molded rubber core members occupying a cross-sectional quadrant defined by horizontal neutral plane 43 and a central lateral measuring plane 44, both extending lengthwise amidship of carrier means 34 and roll position measuring apparatus 29. Upper right and left rubber core members 45,46 and lower right and left rubber core members 47,48, each having a lightner opening 49, tend to compress above the horizontal neutral plane 43 and stretch below said plane, when carrier means 34 traverses a curved conveyor roll section of caster 10.

All elastomeric core members 45, 46, 47, 48 are so assembled with rubber spacers in such manner as to provide transducer channel opening 50 extending lengthwise of carrier means 34 equidistant both sides of lateral measuring plane 44, thereby to provide free and unrestricted space for the seven distance measuring transducers mentioned above. Three lateral spaces are provided at ends and midway for transducers X, Y, Z, and four diagonal spaces are provided therebetween for transducers A, B, C, D. Three lateral spaces are provided typically by rubber spacer 51 positioned in opening 50 and secured in place through upper and lower right and left core members 45, 46, 47, 48 by bolts 52,53 having a common washer 54 under both bolt-heads and nuts. The four diagonal spaces are provided typically by rubber spacers 55,56. Spacer 55 is positioned in opening 50 and secured through each upper core members 45,46 through bolt 57, the latter having an individual nut and washer. Spacer 56 is also positioned in opening 50 and secured through each lower core member 47,48 through bolt 58, the latter having an individual nut and washer.

The force exerted by elastomeric core 38 against parallel sensing surfaces 36,37 is controlled by tightening all bolts 52, 53, 57, 58 so as to provide a suitable outward force to always cause sensor surfaces 36,37 to be in contact with upper and lower roll faces of conveyor roll pairs in both straight and curved roll sections of caster 10. Free ends of core members 45, 46, 47, 48 are typically restrained together by tie bolt 59. Tie bolt 59 is anchored typically in the end of either upper or lower sensor surface 36 or 37 by eye bolt 60 as shown in FIG. 2.

Each transducer A, B, C, D, X, Y, Z in distance measuring means 35 is mounted in an adjustable connecting linkage which is pivotally linked either laterally or diagonally between the upper and lower parallel sensing surfaces 36,37. Pivotal linkage connections are provided by upper attaching lugs 61, 62, 63 and lower attaching lugs 64, 65, 66. Each lug is secured to the interior of a respective upper and lower parallel sensor surface 36,37, along lateral reference plane 44, and within transducer channel opening 50 and at specific spacings noted below. All transducers are provided with a pinned forked end 67 adapted to adjust the length of each transducer linkage so as to result in the following relationships.

Figure 1:
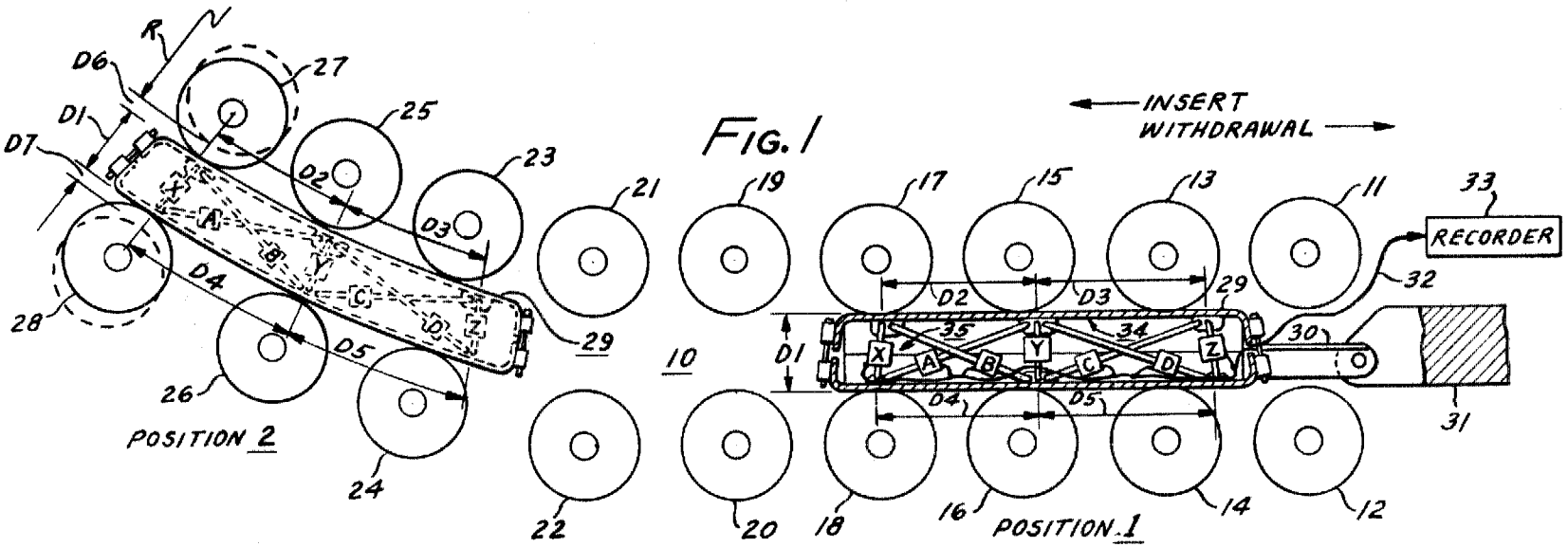
FIG. 1 is a schematic cross-sectional profile of a caster at a conveyor roll section showing conveyor roll position measuring apparatus of this invention, first at a straight section and second at a curved section of said caster.

When roll position measuring apparatus 29 is flat between straight sections of caster 10 conveyor rolls as shown in FIG. 2 and FIG. 1 at Position 1, transducer Y, when aligned perpendicular to parallel sensing surfaces 36,37 senses laterally a nominal roll gap dimension designated D1. Dimensions D2,D3 between attaching lugs 61-62, 62-63 are equal. Dimensions D4,D5 between attaching lugs 64-65, 65-66 are also equal, but larger than D2,D3, so that transducer X,Z are slightly inclined toward each other and sense a slightly larger than normal roll gap dimension D1 than transducer Y. Transducers A,D sense roll alignment diagonally at the same dimension, which dimension is slightly larger than the same dimension sensed as roll alignment diagonally by transducers C,B.

Thus, when roll position measuring apparatus 29 is inserted between straight conveyor rolls in Position 1 by starter bar 31, roll gap D1 is sensed directly by transducer Y and less accurately but at a known amount of error by transducers X, Z. Lower and upper roll alignments are sensed by transducers C,D. When starter bar 31 withdraws roll position measuring apparatus 29, roll gap is sensed the same, but lower and upper roll alignments are sensed by transducers A,D.

When roll position measuring apparatus 29 is curved at radius R between curved sections of caster 10 conveyor rolls as shown in FIG. 1, Position 2, transducers X, Y, Z all lie on a radius R perpendicular to parallel sensing surfaces 36,37, and each senses laterally a nominal roll gap dimension D1. Transducer Y sensing remains the same as in Position 1, but transducers X,Z sensing decreases slightly to equal that of Y. As compared to Position 1 transducers A,D, sense roll alignment diagonally slightly less, transducers C,B, slightly larger, but transducers A, B, C, D now sense roll alignment diagonally by equal amounts. Position 2 configuration provides roll position measuring apparatus 29 with more accurate sensing of conveyor roll gap and roll alignment in the curved section of caster 10 where roll diameters get smaller and roll tolerances are more critical.

Thus, when roll position measuring apparatus 29 is inserted between curved conveyor rolls in Position 2 by starter bar 31, roll gap D1 is sensed by each transducer X, Y,Z. Lower and upper roll alignments are sensed by transducers A,B for roll gap transducer X, or by transducers C,D for roll gap transducer Y. When starter bar 31 withdraws roll position measuring apparatus 29, roll gap sensing is the same, but lower and upper roll alignments are sensed by transducers C,D for roll gap transducer Z, or by transducers A,B for roll gap transducer Y. It willl now be apparent that this configuration provides more accurate measurements, with greater flexibility and redundancy than heretofore, all highly advantageous features desired by caster operators, particularly when having to deal with critical roll diameters and tolerances.

When roll position measuring apparatus 29 is used in either Position 1 or 2 described above, transducers A, B, C, D, X, Y, Z output signals are fed through cable 32 to recorder 33. Recorder 33 has at least seven recording channels, the record of which is read and analyzed by a caster operator.

It will now be understood that there are no transducers connected to or with a horizontal neutral plane 43 as occurs in prior art methods and apparatus. In the present invention, all distance measuring is done by transducers A, B, C, D, X, Y, Z, and these are sensed independently of a neutral or reference plane, thus obviating the need of one or more separate transducers for such purpose.

Specific examples of how strand-like roll position measuring apparatus 29 work in caster 10 will now be given. Assume that by moving strand-like roll position measuring apparatus 29 to plural roll locations along the strand travel path, the lateral and diagonal distance measuring transducers will generate roll gap and roll alignment signals as described above. Further assume that caster conveyor roll radius of curvature is 480", D1 nominal roll gap is 10.314", D2,D3 dimensions are each 20.549" and D4,D5 dimensions are each 21.0".

When roll position measuring apparatus 29 is straight as shown in Position 1, roll gap transducer Y will sense 10.314", transducers X,Z each sense 10.324", roll alignment transducers A,B sense 23.396" and transducers C,D each sense 22.992". Any difference in roll gap or roll alignment from normal will cause a corresponding change in measurement sensed by the respective transducer as explained below.

As roll position measuring apparatus 29 is moved to Position 2, assuming there is no actual change in roll gap or roll alignment, there is no change in roll gap transducer Y, that is, it senses 10.314" for D1. When making the transition from straight to curved roll sections, roll gap transducers X,Z each decreased 0.010" to 10.314" which is the same as transducer Y senses. Also, roll alignment transducers A,B, decrease 0.195" to 23.202", and transducers C,D, increase 0.210" to 23.202", thereby all roll alignment transducers sensing the same distance even though there was no actual change in roll alignment.

Assume that in Position 2 upper roll 27 were out of alignment by D6 distance shown dotted in FIG. 1, and this was equal to 0.010", then transducer X will sense an increase of 0.010" in roll gap above normal D1 to 10.324", and transducer B will sense an increase of only 0.004". Transducers A, C, D, Y, Z will sense no change. If upper roll 27 position were instead inward 0.010", the change in sensing would be in the opposite direction. That is, transducer X will sense a decrease of 0.010" in roll gap below normal D1 to 10.304", while transducer B will sense a decrease of only 0.004" and the other transducers will sense no change.

If lower roll 28 were out of alignment by D7 distance shown dotted in FIG. 1 and this was equal to 0.015", then transducer X will also sense an increase of 0.015" in roll gap above normal D1 to 10.329" and transducer A will sense an increase of only 0.006". Transducers B, C, D, Y, Z will sense no change. If lower roll 28 position were instead inward 0.015", the change in sensing would be in the opposite direction. That is, transducer X will sense a decrease of 0.015" in roll gap below normal D1 to 10.299", while transducer A will sense a decrease of only 0.006". Transducers B, C, D, Y, Z will sense no change.

If a situation should arise that both upper and lower rolls 27,28 were out of alignment in either direction described above, then transducer X will sense the actual roll gap, and transducers A and B will sense how much each roll 27,28 was out of alignment and whether the rolls were inward or outward of their normal position. As roll position measuring apparatus 29 is moved by starter bar 31 past upper and lower rolls 27,28, transducers Y,Z will also sense the change in roll gap and transducers C,D will again sense the same roll alignment problem, thereby confirming previous results with a second record. When starter bar 31 withdraws roll position measuring apparatus 29, then the notation of transducer identification is reversed. That is, transducer Z followed by Y and X in that order designate roll gap sensing, while transducers C,D followed by B,A designate roll alignment sensing.

Figure 4:
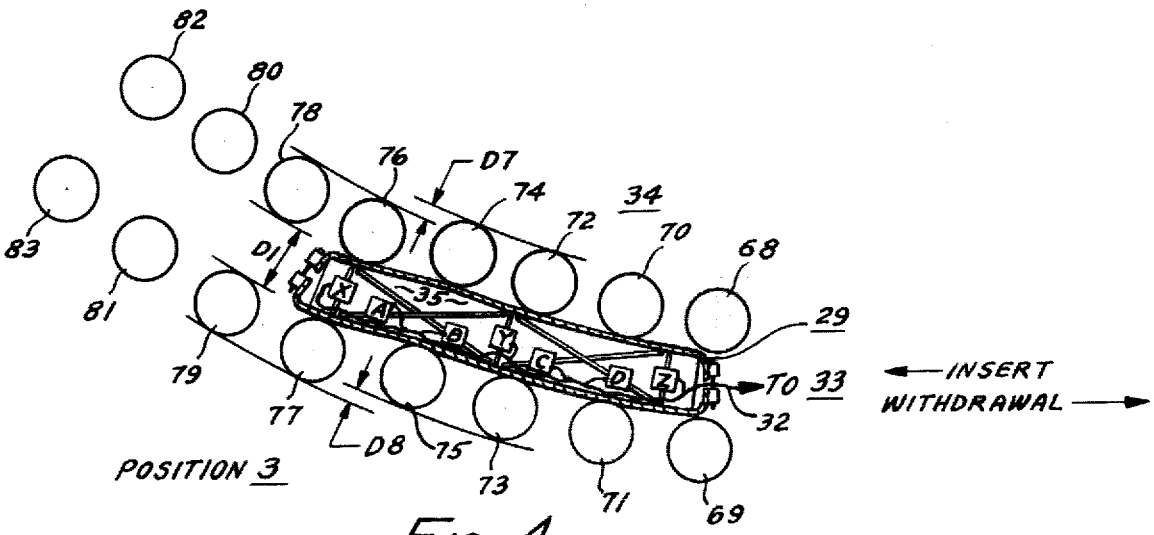
FIG. 4 is a schematic cross-sectional profile of a curved caster roll section having one segment of conveyor rolls offset from another segment with roll position measuring apparatus of this invention shown between roll segments.

Referring to FIG. 4, there is illustrated a caster 10 having a first segment of curved conveyor rolls out of alignment with a second segment of rolls and a roll position measuring apparatus 29 of this invention is used at Position 3 to detect this condition. The first segment of curved rolls comprises upper and lower rolls 68–75, and the second segment of rolls out of alignment from the first comprises upper and lower rolls 76–83. Out of alignment dimensions are identified as D7, D8, specifically between upper rolls 74,76 and lower rolls 75,77, respectively. Assume that all conditions of roll position measuring apparatus 29 are the same as noted above for Position 2 in FIG. 1, D1 in normal at 10.314" and D7,D8, are each represented as misalignment of 0.020".

In this example, the second segment is out of alignment with the first segment by 0.020", but the roll gap remains normal at 10.314". When starter bar insertion causes transducer X to reach upper and lower rolls 76,77, transducer X will sense no change in dimension, but transducer A will sense an increase of 0.008" and transducer B will sense a decrease of 0.008", the other transducers will experience essentially no change.

When roll position measuring apparatus 29 is moved between any opposite pair of rolls that revolve and transducers X, Y, Z, each sense distinctive dimensions, a bent roll is indicated at the axis traversed by apparatus 29. Transducers A, B, C, D will also sense a change in roll alignment and indicate which roll is bent.

Further, in actual practice there is a definite geometrical relationship between the value sensed by roll alignment transducers A, B, C, D, and the actual value thereof. For example, although transducers A, B, C or D may have sensed only a change of 0.004" to 0.006", this change corresponds to an actual roll misalignment of 0.010" to 0.015" on caster 10 as described above. However, all of the transducer output signals from distance measuring means 35 are amplified by means not shown before being fed to recorder 33. In this manner, abnormal readings may be quickly detected by the caster operator and the cause, whether it is improper roll gap or roll misalignment, and the extent of both these problems may also be identified.

Figure 6:
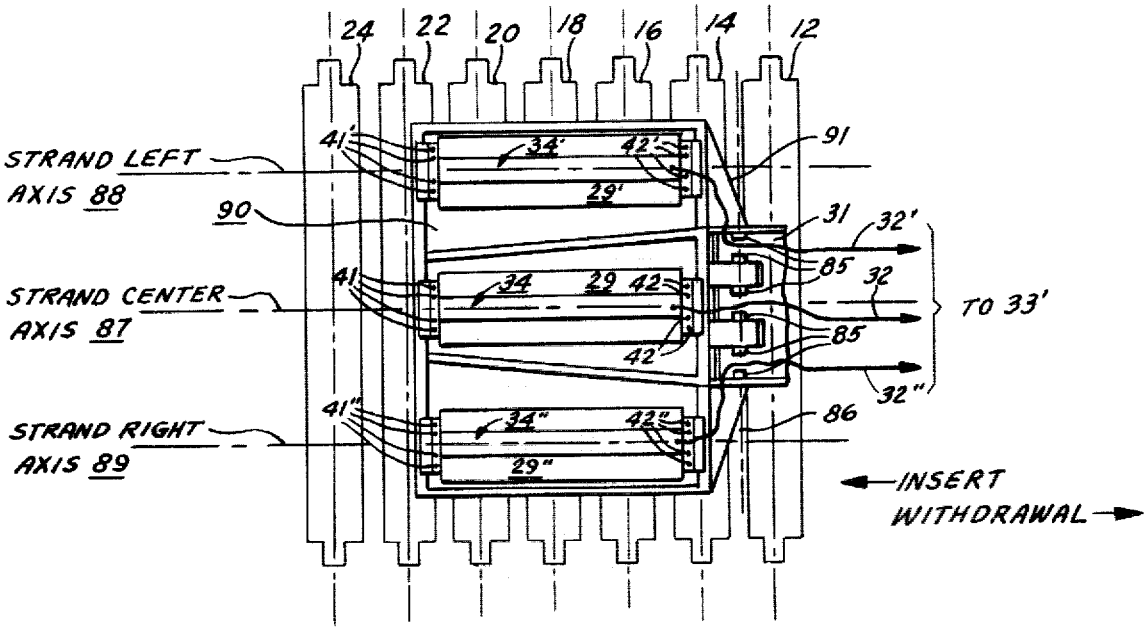
FIG. 6 is a schematic plan view of a multiple harness having three conveyor roll position measuring apparatus in parallel adapted to a starter bar for simultaneous insertion or withdrawal at all three strand axes.

Turning now to FIGS. 5 and 6, illustration is made in schematic plan view of single and multiple harness embodiments incorporating single and multiple conveyor roll position measuring apparatus attached to starter bar 31 at various lateral strand travel axes in caster 10. These embodiments offer means for detecting conveyor roll gap, roll alignment and bent rolls at various lateral strand axes in a choice of either a single pass or mulitple passes, in either insertion or withdrawal modes of operating starter bar 31. In each FIG. 5 and 6, the top layer of opposing conveyor rolls has been removed for purposes of clarity. In addition, cross-sectional details will be found in FIGS. 2 and 3.

FIG. 5 shows a single harness 30 made of metal framework sized to hold a single conveyor roll position measuring apparatus 29 and adapted for starter bar 31 insertion or withdrawal over conveyor rolls 12–24 in one or more passes at any of three lateral strand axes. Harness 30 framework secures at front and rear ends strand-like carrier means 34 by way of four retaining bolts 41 at the front end and four retaining bolts 42 at the rear end. In this manner upper and lower sensing surfaces 36,37 (not shown) may be permitted to follow roll contours and roll segment curvature characteristics.

Single harness 30 is made with framework adapter 84 at its rear end and fitted with hinge pins 85, all sized for pivotal connection to starter bar 31 along hinge line 86. If a single pass is sufficient to determine conveyor roll position, that is roll gap and roll alignment, then starter bar 31 causes single harness 30 to be inserted and withdrawn in the center of caster 10 along a strand travel path identified as strand center axis 87. When caster 10 has a wide strand, it is desirable to modify framework adaptor 84 or starter bar 31 end to permit roll position measurements to be made by apparatus 29 shown dotted at additional strand travel paths identified as strand left and right axes 88,89.

Whenever either the single or multiple strand axis roll positions are sensed by conveyor roll position measuring apparatus 29, the seven transducer signals from distance measuring means 35 (not shown) are fed over cable 32 to seven-channel recorder 33 (not shown) which produces one to three sets of recordings that will be analyzed by a caster operator as noted above.

When caster 10 has a wide strand and availability of down-time is a premium, it is highly desirable to employ the FIG. 6 embodiment of this invention. Here a multiple harness 90 made of metal framework sized to hold three parallel conveyor roll position measuring apparatus 29,29',29" and adapted for starter bar insertion or withdrawal over conveyor rolls 12–24 in a single pass at three lateral strand axes simultaneously. Multiple harness 90 secures at front and rear ends three strand-like carrier means 34, 34', 34" in parallel by way of four retaining bolts 41,41',41", at the front end and four retaining bolts 42,42',42" at the rear end of each said carrier means. In this manner, corresponding upper and lower sensing surfaces (not shown) may be permitted to follow roll contours and roll segment curvature characteristics at respective locations simultaneously.

Multiple harness 90 framework is made with framework adapter 91 at its rear end and fitted with hinge pins 85, all sized for pivotal connection to starter bar 31 along hinge line 86. Starter bar 31 inserts and withdraws multiple harness 90 in such a way that the three parallel roll position measuring apparatus 29,29',29" move simultaneously along strand travel paths identified as strand center axis 87, strand left axis 88, strand right axis 89, respectively. Thus, roll position measurements are made only during a single pass of a wide strand caster 10. Alternatively, a single conveyor roll position measuring apparatus 29 may be fitted in multiple harness 90 at any one of strand axes 87, 88, 89 locations and make successive passes at each different location.

Whenever the single-pass multiple-strand axis is used to detect roll positions sensed by conveyor roll position apparatus 29,29',29", the seven transducer signals from each distance measuring means 35,35',35" (not shown) are fed over cables 32,32',32" to a twenty-one channel recorder 33' (not shown) which produces one set of multiple recordings in one pass that will be analyzed by a caster operator, also as noted above. In addition, when the multiple harness 90 is used with a single roll position measuring apparatus at any one or all three locations, transducer signals will be recorded on a seven-channel recorder 32 (not shown) also as described above.

I claim:

1. Method of measuring roll position between roll faces of a series of oppositely spaced pairs of conveyor rolls which define a strand travel path, which method comprises:

(a) moving strand-like position measuring apparatus to plural roll locations along an axis of said path, said apparatus having resiliently deformable parallel sensing surfaces extending between two or more pairs of roll faces;

(b) generating a signal representing roll position of opposite roll faces by sensing a dimension including lateral and diagonal distance between said sensing surfaces, said distance sensing being performed independently of a neutral or reference plane; and (c) recording said signal at each location along said path.

2. The method of claim 1 wherein a roll gap signal is generated by sensing a lateral distance between said sensing surfaces.

3. The method of claim 1 wherein a roll alignment signal is generated by sensing a diagonal distance between said sensing surfaces.

4. Method of measuring roll position between roll faces of a series of oppositely spaced pairs of conveyor rolls which define a strand travel path, which method comprises:

(a) moving strand-like position measuring apparatus to plural roll locations along an axis of said path, said apparatus having resiliently deformable parallel sensing surfaces extending between two or more pairs of roll faces;

(b) generating a roll gap signal by sensing a lateral distance between said sensing surfaces;

(c) generating a roll alignment signal by sensing a diagonal distance between said sensing surfaces; and (d) recording each said signal at each roll location along said path.

5. The method of claim 4 wherein any of said distance sensing is performed independently of a neutral or reference plane.

6. The method of claims 1 or 4 wherein plural roll position signals are generated by sensing corresponding plural distances between said sensing surfaces.

7. The method of claim 6 wherein two roll alignment signals are generated by sensing two diagonal distances associated with upper and lower roll faces of one said pair of roll faces.

8. The method of claims 1 or 4 wherein moving of said measuring apparatus occurs over both straight and curved sections of said strand travel path.

9. The method of claims 1 or 4 wherein said measuring apparatus is inserted then withdrawn between roll faces when generating a roll position signal.

10. The method of claim 1 or 4 including the step of repeating the foregoing moving, signal generating and recording steps at another strand axis lateral of the previous axis of the strand level path, thereby to determine lateral roll surface condition or alignment during multiple passes at one or more locations along said path.

11. The method of claim 1 or 4 wherein the steps of moving, signal generating and recording are modified to include simultaneously moving plural measuring apparatus along different lateral axes of said path at one or more locations along said path, simultaneously generating plural signals representing respective lateral roll position at each said lateral axis, and simultaneously recording each said signal, thereby to determine in one pass of said plural measuring apparatus the lateral roll surface condition or alignment at one or more locations along said path.

12. Apparatus for measuring roll position between roll faces of a series of oppositely spaced pairs of conveyor rolls which define a strand travel path, comprising:

(a) strand-like carrier means movable to plural roll locations along an axis of said path, said carrier means having resiliently deformable parallel sensing surfaces exerted outwardly and extending between two or more pairs of roll faces; and (b) distance measuring means pivotally linked to sense a dimension including lateral and diagonal distance between said carrier means sensing surfaces for generating a signal representing roll position of opposite roll faces, said distance measuring sensed independently of a neutral or reference plane.

13. The apparatus of claim 12 wherein the distance measuring means generates a roll gap signal when sensing a lateral distance between said surfaces.

14. The apparatus of claim 12 wherein the distance measuring means generates a roll alignment signal when sensing a diagonal distance between said sensing surfaces.

15. Apparatus for measuring roll position between roll faces of a series of oppositely spaced pairs of conveyor rolls which define a strand travel path, comprising:

(a) strand-like carrier means movable to plural roll locations along an axis of said path, said carrier means having resiliently deformable parallel sensing surfaces exerted outwardly and extending between two or more pairs of roll faces;

(b) lateral distance measuring means pivotally linked laterally to the carrier means sensing surfaces for generating a roll gap signal; and (c) diagonal distance measuring means pivotally linked diagonally to the carrier means sensing surfaces for generating a roll alignment signal.

16. The apparatus of claim 15 wherein said distance measuring means senses distance independently of a neutral of reference plane.

17. The apparatus of claims 12 or 15 wherein said distance measuring means generates plural roll position signals by sensing corresponding plural distances between said carrier means sensing surfaces.

18. The apparatus of claim 17 wherein said distance measuring means generates two roll alignment signals by sensing two diagonal distances associated with upper and lower roll faces of one pair of said roll faces.

19. The apparatus of claims 12 or 15 wherein the strand-like carrier means is movable over straight and curved sections of said strand travel path.

20. The apparatus of claims 12 or 15 wherein the strand-like carrier means is inserted, then withdrawn, between roll faces when generating a roll position signal.

21. The apparatus of claims 12 or 15 further including means for recording each said roll position signal at each location along said path.

22. The apparatus of claims 12 or 15 further including single harness means for pivotally mounting one or both ends of one carrier means to a strand starter bar at one or more lateral strand axes, thereby to determine lateral roll surface condition or alignment during multiple passes at one or more locations along said path.

23. The apparatus of claims 12 or 15 further including plural harness means for pivotally mounting each one or both ends of one or plural carrier means to a strand starter bar at plural lateral strand axes, thereby to determine lateral roll surface condition or alignment during multiple passes using one carrier means, or during a single pass using plural carrier means, at one or more locations along said path.

* * * * *